US005192348A

United States Patent [19]

Ludwig

[11] Patent Number: 5,192,348

[45] Date of Patent: Mar. 9, 1993

[54] DIRECTIONAL AIR DIFFUSER PANEL FOR CLEAN ROOM VENTILATION SYSTEM

[75] Inventor: Craig S. Ludwig, Portland, Oreg.

[73] Assignee: Brod & McClung-Pace Co., Portland, Oreg.

[21] Appl. No.: 748,229

[22] Filed: Aug. 21, 1991

[51] Int. Cl.[5] ..... B01D 46/00

[52] U.S. Cl. ..... 55/385.2; 55/484; 55/DIG. 29; 454/187; 454/296

[58] Field of Search ..... 55/484, 502, 385.2, 55/DIG. 29; 454/187, 293, 296

[56] References Cited

U.S. PATENT DOCUMENTS

| | | | |
|---|---|---|---|
| 2,172,771 | 9/1939 | Norris | 98/33 |
| 3,280,984 | 6/1964 | Sexton et al. | 210/485 |
| 3,432,999 | 12/1967 | Ernst-Schraner | 55/490 |
| 3,487,766 | 1/1968 | Wood | 98/31 |
| 3,630,008 | 12/1971 | Revell | 55/493 |
| 3,715,578 | 2/1973 | Wood et al. | 240/9 R |
| 3,740,934 | 6/1973 | Shuler | 55/490 |
| 3,776,121 | 12/1973 | Truhan | 454/296 |
| 3,782,082 | 1/1974 | Smith et al. | 55/494 |
| 3,975,995 | 8/1976 | Shuler | 98/40 |
| 3,984,221 | 10/1976 | Cotton | 55/501 |
| 4,094,232 | 6/1978 | Howorth | 98/36 |
| 4,175,936 | 11/1979 | Lough et al. | 55/385.2 |
| 4,267,769 | 5/1981 | Davis et al. | 98/33 |
| 4,409,889 | 10/1983 | Burleson | 98/33 |
| 4,461,205 | 7/1984 | Shuler | 98/40 |
| 4,549,472 | 10/1985 | Endo et al. | 454/187 |
| 4,554,766 | 11/1985 | Ziemer et al. | 52/28 |
| 4,580,381 | 4/1986 | Sodec et al. | 55/484 |
| 4,600,419 | 7/1986 | Mattison | 55/484 |
| 4,603,618 | 8/1986 | Soltis | 98/31.5 |
| 4,608,066 | 8/1986 | Cadwell, Jr. | 55/385 |
| 4,671,811 | 6/1987 | Cadwell, Jr. et al. | 55/355 |
| 4,678,487 | 7/1987 | Cadwell, Jr. et al. | 55/385 |
| 4,683,699 | 8/1987 | Larsson | 52/775 |
| 4,710,208 | 12/1987 | Ziemer et al. | 55/355 |
| 4,724,749 | 2/1988 | Hedrick | 98/31.5 |
| 4,747,341 | 5/1988 | Hedrick | 98/31.5 |
| 4,776,263 | 10/1988 | Lokander et al. | 98/40.07 |
| 4,819,549 | 4/1989 | Gillingham et al. | 98/1 |
| 4,860,420 | 8/1989 | Cadwell, Jr. et al. | 29/157 |
| 4,883,513 | 11/1989 | Monson et al. | 55/385 |
| 4,946,484 | 8/1990 | Monson et al. | 55/385 |
| 4,986,050 | 1/1991 | Brunetti et al. | 55/484 |

FOREIGN PATENT DOCUMENTS

| | | |
|---|---|---|
| 2624252 | 12/1987 | France . |
| 456754 | 10/1988 | Sweden . |

*Primary Examiner*—Bernard Nozick
*Attorney, Agent, or Firm*—Klarquist Sparkman Campbell Leigh & Whinston

[57] ABSTRACT

A clean room diffuser panel for positioning below a ceiling grid mounted filter element. The diffuser panel is perforated throughout its area with increased size and density of perforations in a peripheral region to provide increased airflow beneath the ceiling grid. The peripheral regions are further angled or provided with directional vanes to create a lateral airflow beneath the ceiling grid.

15 Claims, 3 Drawing Sheets

DIRECTIONAL AIR DIFFUSER PANEL FOR CLEAN ROOM VENTILATION SYSTEM

TECHNICAL FIELD

This invention relates to diffusers for reducing airflow turbulence, and more particularly for diffuser panels for use with clean room ceiling filter panels.

BACKGROUND AND SUMMARY OF THE INVENTION

In addition to the filtering effect provided by clean room ventilation systems, such systems are generally designed to reduce turbulence by providing a generally laminar airflow pattern. In a laminar flow clean room, air typically flows downward from the ceiling to the floor so that a contaminant particle, such as might be shed by a worker, would be drawn directly downward to be removed by a filter. Thus, such a particle would spend no more than a few seconds in the clean room. Where the airflow is turbulent, there are eddies that create localized upward airflow currents. A contaminant particle might be trapped in such an eddy for up to several minutes. Consequently, turbulent airflow generally results in a higher concentration of contaminants at any given time and creates a greater likelihood that such contaminants might come to rest on sensitive equipment or materials.

Perforated diffuser panels are commonly used in clean room ceilings to reduce turbulence and to provide a generally laminar airflow. Such diffuser panels are typically positioned below ceiling-mounted filter elements, preferably with at least a small space in between. Although air may exit the filter element at uneven pressures across the element, the diffuser panel creates a small backpressure which equalizes the air pressure in the space above the panel. The air then passes through perforations in the diffuser panel, with the perforations acting as point sources having generally equal flow rates. Although there is turbulence immediately below the diffuser panel due to the "nozzle effect" of the perforations, such turbulence is quickly dissipated. Typically, such turbulence becomes negligible at a distance below the diffuser panel equal to several times the diameter of the perforations.

However, while a single diffuser panel can provide an effectively laminar airflow away from boundaries or obstructions, clean room ventilation systems are typically constructed with multiple filter elements mounted in a grid system to permit modular manufacturing and assembly. In such a system, each filter element is separated from adjacent filter elements by a "dead zone" occupied by a grid structural element creating an obstruction to air flow with a corresponding airflow dead zone immediately below. As a result, air flowing downward from the periphery of a filter element tends to be drawn into the airflow dead zone and form a turbulent vortex having an upward airflow beneath the grid element. A rule of thumb predicts that a turbulence zone extends downstream of an obstacle by a distance of about four times the obstacle's width. Thus, in typical systems having a frame or grid element with a width of two to three inches, the turbulence zone may extend 12 inches below the ceiling surface, substantially impairing the clean room function.

An existing approach to reduce the turbulence between filter elements is to extend a V-shaped shroud beneath the grid element. Such a shroud is usually in the form of a "tear drop" fluorescent light fixture cover, and functions like the trailing edge of an airplane wing, allowing the laminar flow regions from adjacent filter elements to rejoin more smoothly with reduced turbulence. This approach typically reduces the turbulence zone to within about 7 inches of the ceiling surface, an improvement, but still problematic. In addition, tear drop light fixtures have the disadvantage of further reducing ceiling height, which is typically at a premium due to the substantial ducting and equipment required above the ceiling. Also, such light fixtures create an obstacle to modular sub-dividing walls that preferably hang immediately below the ceiling surface without a substantial gap.

From the foregoing it will be recognized that there is a need for an air diffuser panel that overcomes these drawbacks of the prior art by providing an increased or directional airflow at the periphery of the diffuser panels to fill in the dead space below the structural elements and to create a balanced net airflow that becomes generally laminar within close proximity to the ceiling surface. The present invention satisfies this need.

The foregoing additional features and advantages of the present invention will be more readily apparent from the following detailed description which proceeds with reference to the accompanying drawings.

DETAILED DESCRIPTION OF A PREFERRED EMBODIMENT

Figure 1:
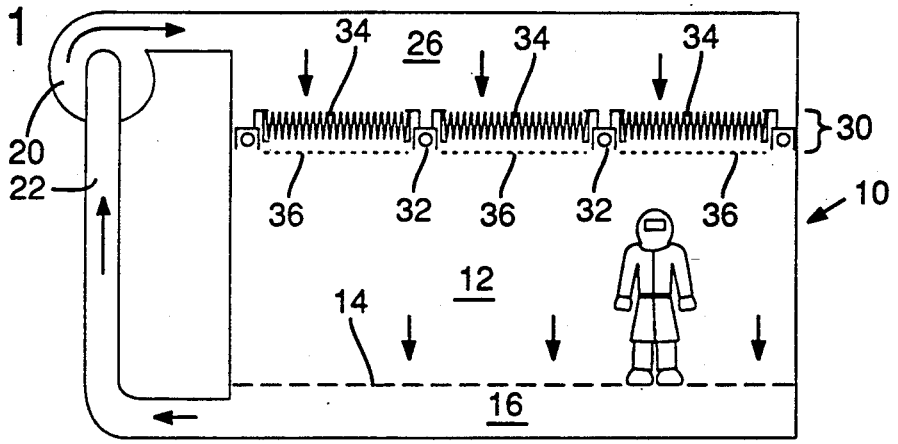
FIG. 1 is a sectional side view of a clean room system according to the present invention.

FIG. 1 shows a clean room system 10 for providing an uncontaminated downward laminar airflow in an enclosed chamber 12. The chamber includes a perforated floor 14 with a subspace 16 below the floor 14. A blower 20 draws air through a duct 22 in communication with the subspace 16 and expels it at a higher pressure into a plenum 26 above the chamber 12.

A ceiling 30 separates the plenum 26 from the chamber 12. The ceiling 30 generally includes a rigid grid structure formed of grid elements 32, with the grid elements arranged orthogonally to define a matrix of rectangular spaces. A set of rectangular filter elements 34 is carried by the grid elements 32 with each filter element 34 occupying a rectangular space formed by the grid elements. Each filter element 34 is sealed to the grid to prevent airflow between the plenum 26 and clean room chamber 12 from circumventing the filters at its edges. A set of diffuser panels 36 is attached to the ceiling 30, with each diffuser panel 36 being positioned below and generally coextensive with a filter element 34. Each diffuser panel 36 is preferably a rigid perforated sheet for providing a non-turbulent laminar airflow when air is forced through it from a volume of higher pressure above the sheet.

Alternatively, the diffuser panel may be a rigidly supported air-permeable membrane (not shown) formed of flat filter paper media such as a long-strand polyester fiber sheet. Such a sheet may be installed in conjunction with a perforated panel as discussed above, and may be folded and formed by bending the peripheral portions at an angle so that air passing perpendicularly through the peripheral portions of the sheet is directed outwardly. The desired higher volume peripheral flow rate may be provided by manufacturing a composite membrane with a more highly permeable material in the peripheral portions than in the central portions. Alternatively, a single membrane may be perforated at its periphery to provide increased airflow.

Figure 2:
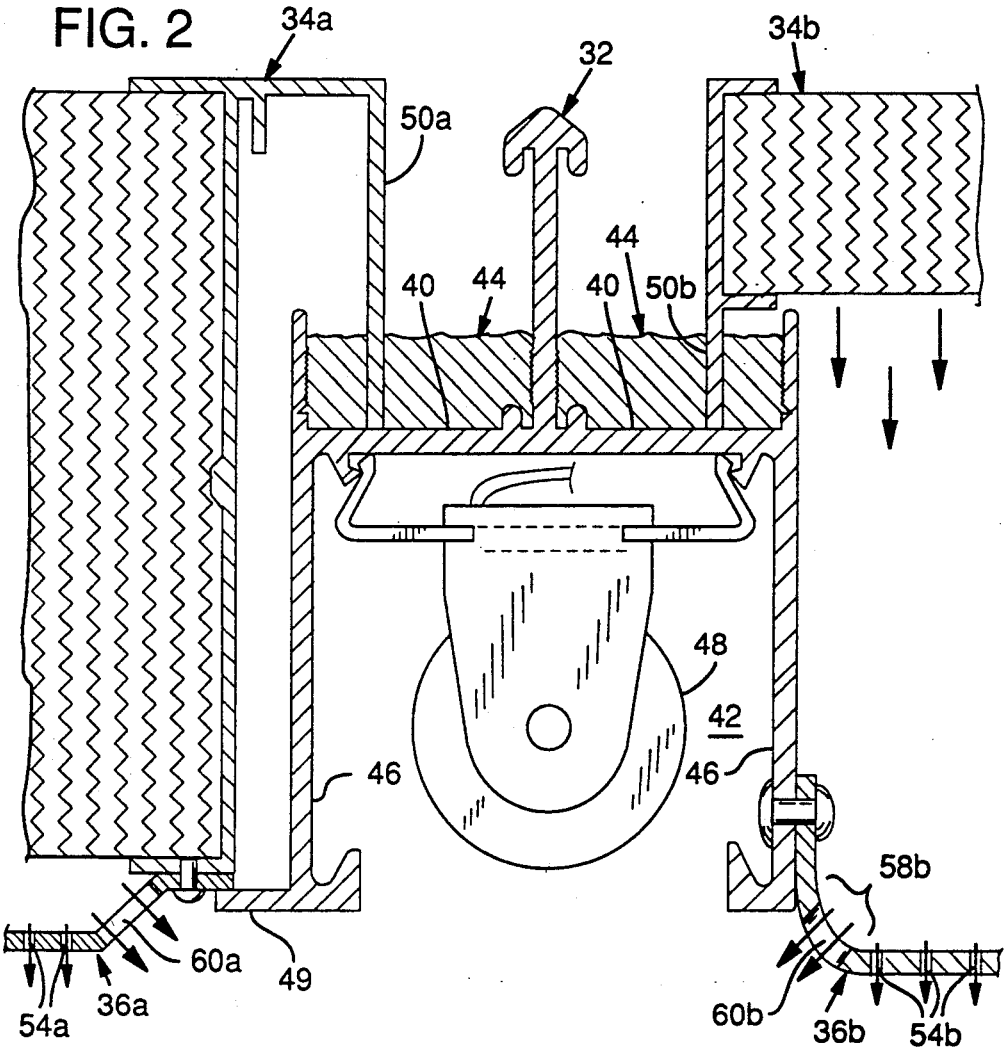
FIG. 2 is an enlarged sectional side view of a grid element junction between adjacent filter elements in the system of FIG. 1, showing alternative filter and diffuser configurations.

As shown in FIG. 2, the grid element 32 has a constant cross-section and is preferably formed of extruded aluminum. The grid element 32 defines a pair of upwardly facing troughs 40, each trough being filled with a gel-like sealant 44. The grid element 32 further defines a large downwardly facing channel 42 defined by opposed, spaced apart grid sidewalls 46. The channel 42 is generally sized to fit a fluorescent light fixture 48 entirely therein. A ledge 49 may extend laterally from the sidewall 46 at its lower edge as shown on the left sidewall in FIG. 2. The ledge 49 provides a resting or attachment point for the filter element 34*a*, and prevents airflow in the space between the filter element and the sidewall 46.

FIG. 2 shows the filter elements 34*a*, 34*b* in two alternative configurations. Preferably, only one of these configurations would be selected and exclusively used throughout each clean room installation. A hanging-type filter 34*a* includes a peripheral flange 50*a* depending downwardly from the top of the filter 34*a* so that a substantial portion of the filter hangs below the flange. A standing-type filter 34*b* includes a peripheral flange 50*b* extending directly downward from the lower edges of the filter, with the entire filter element standing above the flange. Because a flush ceiling surface is desired for functional and aesthetic reasons, a hanging filter 34*a* is used when a diffuser panel 36*a* is to be attached directly to the filter; a standing filter element 34*b* is used when a diffuser panel 36*b* may be attached directly to the lower edge of the grid sidewall 46. To prevent airflow from circumventing the filter elements 34 and contaminating the clean room chamber 12, each element is installed with its peripheral flange 50 received in the gel sealant 44 contained in the troughs 40.

Generally speaking, each diffuser panel 36 is preferably a perforated metal sheet having equally sized and spaced-apart perforations 54 distributed over the majority of the panel's area in its central region. In the preferred embodiment, the total area of the perforations accounts for about 20% of the panel area. This percentage is known as the free area of the panel. The panel 36 may be useful with a free area anywhere within in a wide range. A free area of less than 10% is suitable when a high backpressure and flow resistance is desired; a free area of greater than 90%, such as provided by a honeycomb panel, is useful when substantial backpressure is not necessary. The panel 36 must provide sufficient backpressure to create a lateral airflow that equalizes differences between high pressure zones and low pressure zones below the filter 34. To permit this lateral flow, the diffuser 36 is preferably spaced below the filter element 34, although the diffuser may be mounted adjacent the lower surface of a filter that permits lateral air flow within itself.

Figure 2A:
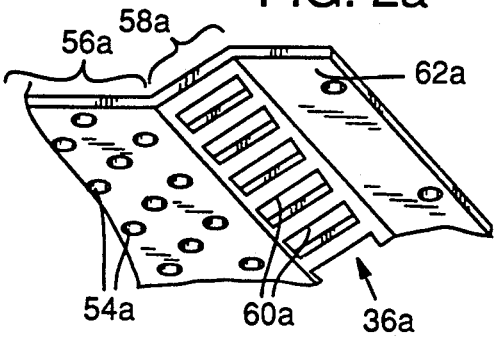
FIG. 2*a* is an enlarged, fragmentary view of a diffuser panel of FIG. 2.

FIG. 2*a* shows a first alternative perforated panel 36*a* suitable for attachment to the filter element 34*a*. The panel includes a central portion 56*a* populated by a plurality of evenly spaced, equally sized central perforations 54*a*. A peripheral portion 58*a* surrounds the central portion 56*a* on all sides and defines an array of peripheral perforations 60*a*. The peripheral perforations 60*a* are larger and more closely spaced than the central perforations 54*a*. Consequently, the peripheral portion has a substantially higher percentage free area than the central portion 56*a* and will permit a greater airflow rate per unit area than the central portion. The peripheral portion 58*a* is angled upward from the central portion 56*a* so that air passing perpendicularly therethrough will be directed peripherally away from the central portion. This deflection angle is preferably about 30 degrees, although the angle may range up to 90 degrees, or be eliminated altogether. The diffuser panel 36*a* is preferably terminated by an edge flange 62*a* that is parallel to the center portion 56*a* and attachable to the edge of the filter element 34*a*. Alternatively, the edge flange 62*a* may rest on the grid ledge 49.

Figure 2B:
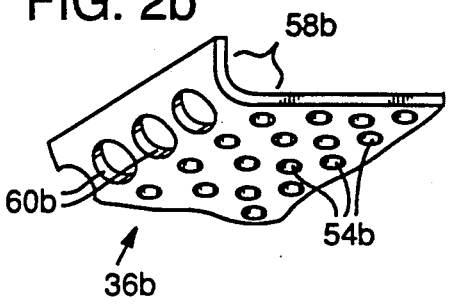
FIG. 2*b* is an enlarged, fragmentary view of an alternative diffuser panel of FIG. 2.

FIG. 2*b* shows an alternative diffuser panel 36*b* suitable for attachment directly to the grid sidewall 46 in conjunction with the standing-type filter element 34*b*. The panel 36*b* is bent perpendicularly at its periphery to create a radiused peripheral portion 58*b* populated by peripheral perforations 60*b*. A plurality of central perforations 54*b* populate the panel and are sized substantially smaller than the peripheral perforations 60*b*. This permits the diffuser panel 36*b* to achieve the same increased peripheral airflow provided by the diffuser panel 36*a*. Similarly, the peripheral airflow is directed away from the center of the diffuser panel 36*b*, because the peripheral perforations 60*b* are centered approximately at the midpoint of the radiused bend of the panel so that they face outward.

Figure 3:
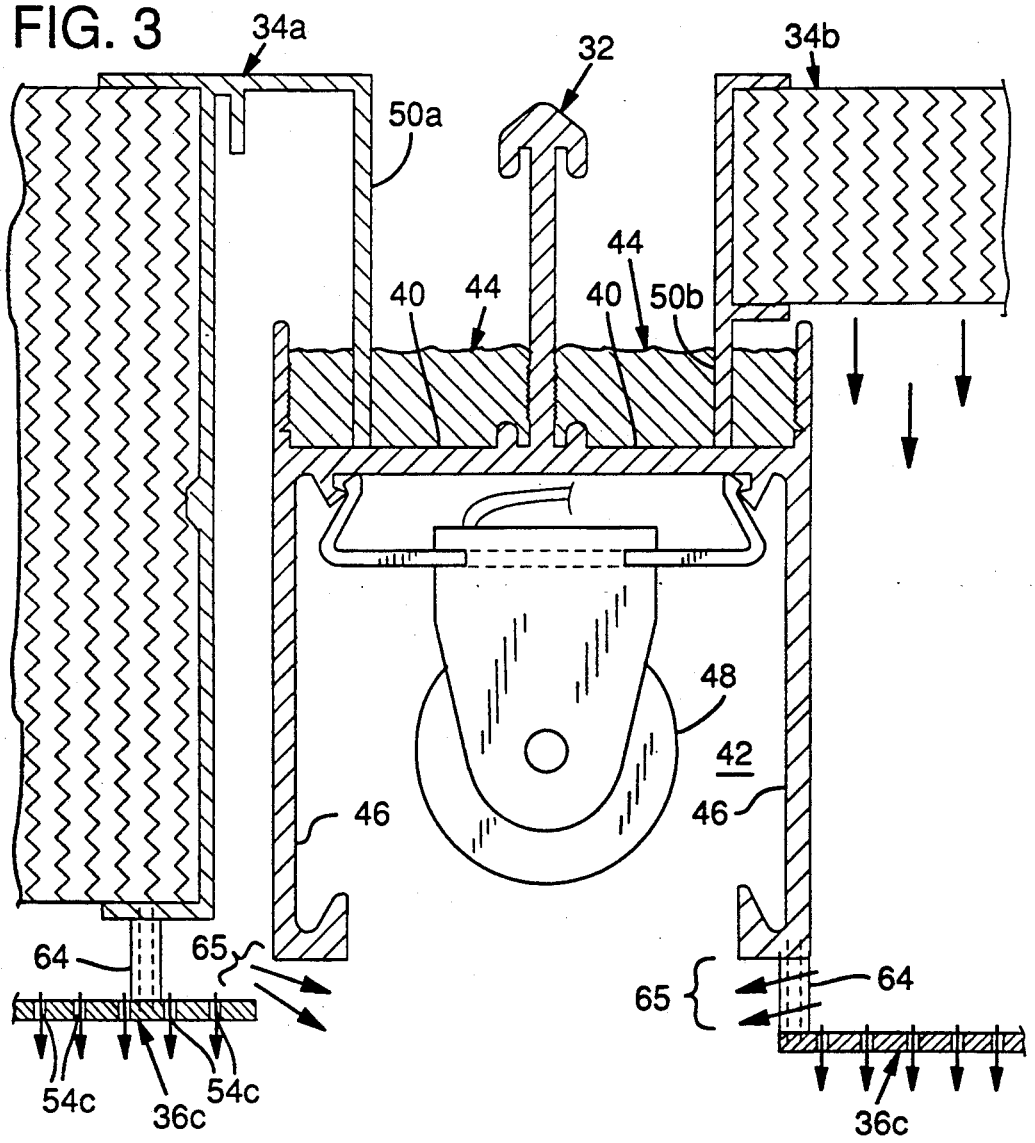
FIG. 3 is an enlarged sectional side view of a grid element junction between adjacent filter elements in the system of FIG. 1, showing additional alternative filter and diffuser configurations.

FIG. 3 shows an alternative diffuser panel 36*c* that is uniformly populated by central perforations 54*c* throughout its area. The panel 36*c* is spaced below the filter element 34*a* so that air may escape laterally beyond the edge of the diffuser panel 36*c*, and below or beside the lower edge of the grid sidewall 46. The space is sized to create a higher flow volume in the lateral airstream than through the central perforations 54*c*. The panel may be directly attached to the lower edge of the filter element 34*a* by spacer posts 64 or other suitable means. The same diffuser panel 36*c* may be used in conjunction with a standing filter element 34*b*, as shown on the right side of FIG. 3, with the panel being attached to and spaced below the lower edge of the grid sidewall 46. In either embodiment of FIG. 3, each panel 36*c* and corresponding grid sidewall define a side gap 65 having an effective free area of 100%.

Figure 4:
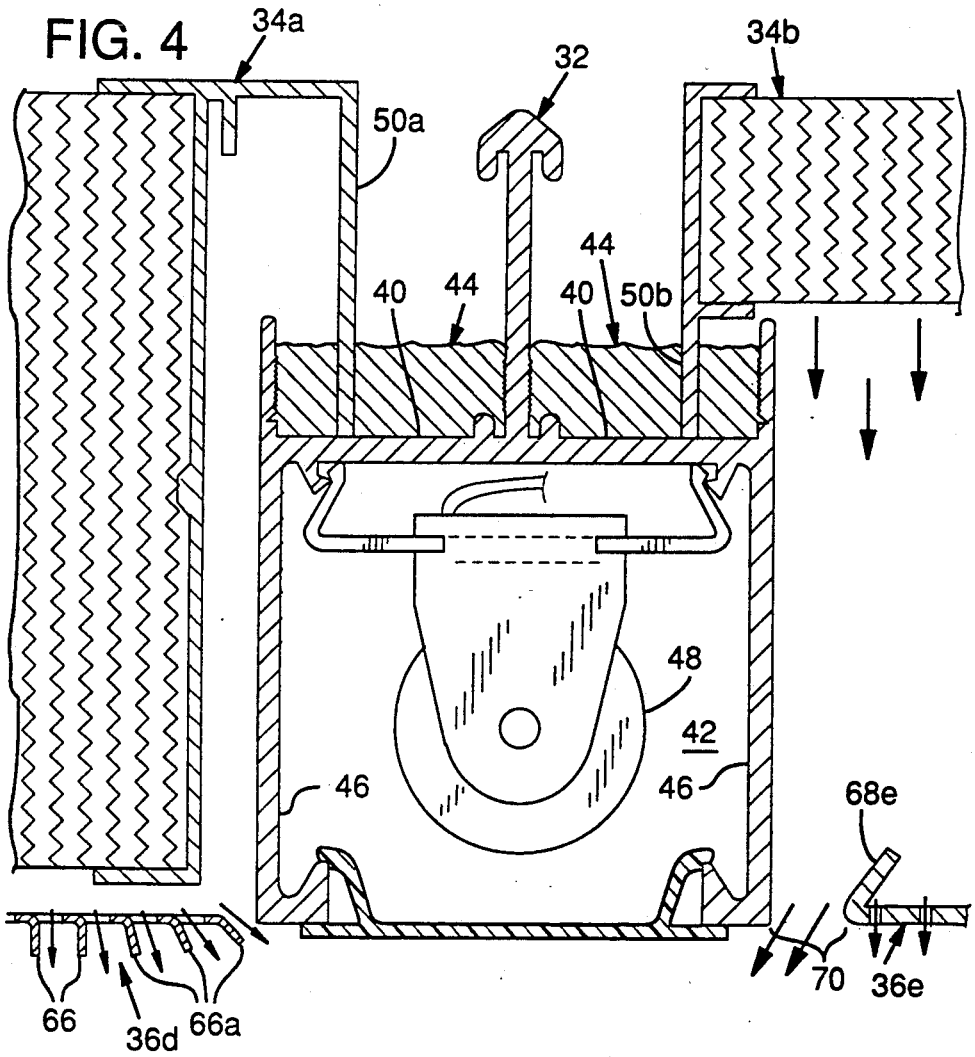
FIG. 4 is an enlarged sectional side view of a grid element junction between adjacent filter elements in the system of FIG. 1, showing further alternative filter and diffuser configurations.

FIG. 4 shows additional alternative diffuser panel configurations. A diffuser panel 36*d* includes vertically oriented vanes 66 in the central portion of the panel and angled vanes 66*a* in the peripheral portion of the panel for directing air peripherally away from the center of the panel. The angled vanes 66*a* are angled from the vertical in correspondence with their proximity to the edge of the panel. In this embodiment, the airflow volume is not substantially increased at the periphery, but the directional effect alone adequately fills in the area underneath the grid element to substantially reduce turbulence.

A further alternative diffuser panel 36*e* is shown on the right side of FIG. 4. In this embodiment, a diffuser panel 36*e* has a peripheral flange 68*e* that is bent upwardly and inwardly at an acute angle to leave a peripheral gap 70 between the panel 36*e* and the grid sidewall 46, thus permitting increased airflow at the periphery. The bent angle of the flange also serves to direct air into the area beneath the grid element 32, acting as a vane and a funnel.

Figure 5:
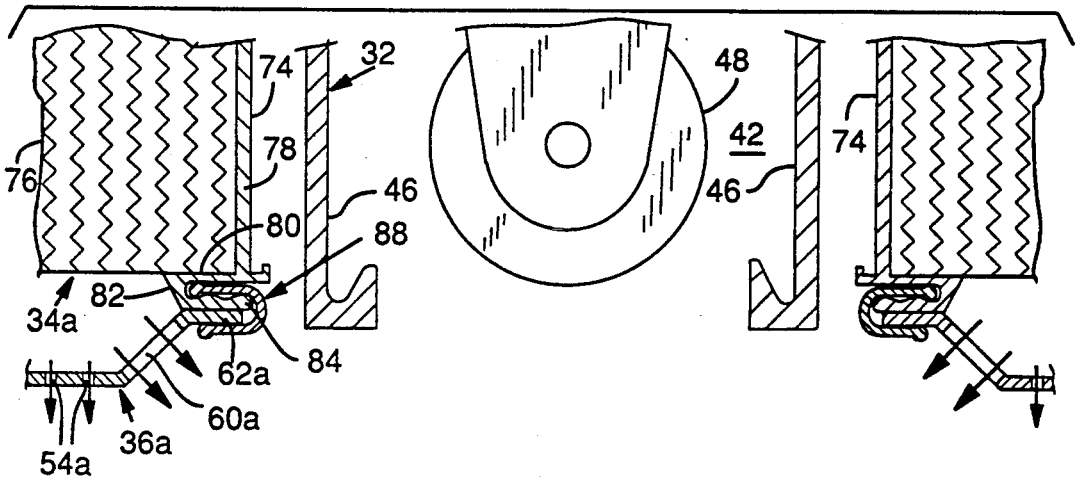
FIG. 5 is an enlarged sectional side view of a junction between a filter element and a diffuser panel according to the present invention.

FIG. 5 illustrates a filter configuration that permits the removable attachment of the diffuser panel 36*a* from below and without requiring removal of the filter element 34*a*. The filter element 34*a* has an extruded aluminum filter frame 74 that peripherally surrounds a mass of filter material 76. The frame 74 includes a frame sidewall 78 with a lower frame ledge 80 attached at a lower edge thereof and extending perpendicularly inward toward the center of the filter panel. A slanted wall 82 is attached to the inner edge of the lower frame ledge 80 with the slanted wall extending downward and peripherally outward to permit airflow to spread outward therebelow. An attachment flange 84 is attached to the lower end of the slanted wall 82 and extends peripherally outward therefrom to be spaced below the lower frame ledge 80. The attachment flange 84 is integral with the filter frame 74 so that it extends around the entire periphery of the filter element 34*a*. The attachment flange 84 is positioned entirely below the filter frame 74 so that it does not extend peripherally outward past the frame element to interfere with the grid sidewall 46 of the grid element 32.

The diffuser panel 36*a* may be positioned for attachment to the filter element 34*a* by positioning the diffuser panel edge flange 62*a* against the attachment flange 84. A U-shaped clip 88 defines a gap for receiving the attachment flange 84 and edge flange 62*a* to bias the flanges together to secure the diffuser panel 36*a* to the filter element 34*a*. The clip 88 may be formed of spring steel or extruded aluminum with a clip extending the full length of each side of the diffuser panel.

As a result of the attachment system shown in FIG. 5, the diffuser panel may be removed and re-attached from below. It is not necessary to remove or disturb the filter element, to enter the plenum 26 or to shut down the clean room system to effect such an operation. The clip 88 has the added aesthetic advantage over conventional screws and rivets in that it does not require drilled holes or visible fasteners.

By providing increased and directional airflow to fill in the area beneath the grid element 32, the diffuser panel 36 effectively provides a net downward airflow beneath the grid element more nearly equal to that which would be provided by replacing the grid elements with an infinite uniform filter element and perforated panel. The airflow below the grid element 32 has sufficient pressure and volume to permit the vertical laminar flow layers flowing from the central portions of the panels to remain vertical and laminar. These layers are thus not drawn upwardly into vortexes beneath the grid element 32.

The initial turbulence beneath the grid element 32 is further minimized by providing a symmetrical airflow from the opposite sides of the grid element 32. Thus, the laterally directed peripheral airstreams will impinge on one another, substantially cancelling their lateral flow and resulting in a generally less turbulent, downward flow. The increased airflow provided by the diffuser panel peripheral regions should create a net airflow below the grid element that is generally equal to the net airflow per unit area in the central regions of the diffuser panels. The velocity of the airflow from the peripheral regions need not be greater than velocity through the central perforations. Only the net airflow rate (e.g. the air volume flow per unit time through unit horizontal area) of the peripheral region need exceed that of the central region. Also, as noted above, this airflow rate differential may act alone to achieve the goals of the invention, or the directional effect alone may provide the same advantages. In the preferred embodiment, both principles act cooperatively.

Having illustrated and described the principles of my invention by what is presently a preferred embodiment, it should be apparent to those skilled in the art that the illustrated embodiment may be modified without departing from such principles. I claim as my invention not only the illustrated, but all such modifications, variations and equivalents thereof as come within the true spirit and scope of the following claims.

I claim:

1. A clean room air diffusion system for controlling an airflow, the system comprising:

a support grid having grid elements defining a panel space for transmitting the airflow, and defining a dead space below the grid elements; and a diffuser panel attached to the grid in registration with the panel space having a central region and a peripheral region, the central region defining a plurality of perforations, the aggregate area of the perforations being a first fraction of the total area of the central region, the peripheral region defining a plurality of openings, the aggregate area of the openings being a second fraction of the total area of the peripheral region, the second fraction being greater than the first fraction, in that the peripheral region is more perforated per unit area than the central region, thereby to fill in the dead space below the grid.

2. The system of claim 1 including an air filter panel supported by the grid for transmitting the airflow.

3. The system of claim 1 wherein the peripheral region includes a terminal edge flange adapted to attach to the grid, with the central region being spaced generally below the edge flange.

4. The system of claim 1 wherein the central region is populated by perforations of a first size, and the peripheral region is perforated by perforations of a larger, second size.

5. The system of claim 1 wherein the central region has a free area of a first amount and the peripheral region has a free area of a greater, second amount.

6. The system of claim 1 wherein the central region perforations are of a uniform first size throughout the central region.

7. The system of claim 6 wherein the peripheral area openings are of a second size larger than the first size perforations.

8. The system of claim 1 wherein the central region defines a central plane and the peripheral region includes an offset portion offset from the central plane such that the openings of the peripheral portion are capable of transmitting air at a velocity having a directional component directed peripherally away from the panel.

9. The system of claim 8 wherein the offset portion is angularly disposed from the first plane.

10. The system of claim 9 wherein the panel is horizontally oriented, with the central region generally lower than the offset portion.

11. The system of claim 1 wherein the diffuser panel comprises an air permeable membrane.

12. The system of claim 11 wherein the membrane is a long strand fiber sheet.

13. The system of claim 11 wherein the membrane is formed of flat filter paper media.

14. A filter and diffuser apparatus comprising:

an air filter having a frame and a filter element supported by the frame for transmitting airflow;

a diffuser panel attached to the filter frame and having a central region defining a set of perforations providing a first free area and a peripheral region defining a set of openings providing a second free area greater than the first free area, in that the peripheral region is more perforated than the central region, such that the peripheral airflow reduces turbulence by filling in the dead space below any adjacent obstacle.

15. The apparatus of claim 14 wherein the peripheral region is angularly disposed from the central region to direct airflow away from the central region.

* * * * *